United States Patent [19]

Duea

[11] Patent Number: 4,747,706

[45] Date of Patent: May 31, 1988

[54] EMBOSSING METHOD AND APPARATUS

[75] Inventor: Duane Duea, Apple Valley, Minn.

[73] Assignee: DataCard Corporation, Minneapolis, Minn.

[21] Appl. No.: 86,067

[22] Filed: Aug. 17, 1987

[51] Int. Cl.[4] ..... B41J 3/38

[52] U.S. Cl. ..... 400/70; 400/130; 400/134

[58] Field of Search ..... 400/130, 131, 134, 134.1, 400/134.2, 61, 62, 70, 76; 101/3 R, 18, 29, 32

[56] References Cited

U.S. PATENT DOCUMENTS

| | | | |
|---|---|---|---|
| 2,533,366 | 12/1950 | Gruver | 400/130 |
| 3,253,691 | 5/1966 | Gollwitzer | 400/130 |
| 3,282,389 | 11/1966 | Rudisoh et al. | 400/130 |
| 3,283,870 | 11/1966 | Gollwitzer | 400/130 |
| 4,031,993 | 6/1977 | Gurgens et al. | 400/130 |
| 4,050,565 | 9/1977 | Heider et al. | 400/130 |
| 4,088,216 | 5/1978 | Lamanna et al. | 400/130 |
| 4,091,910 | 5/1978 | Bolton et al. | 400/131 |
| 4,180,338 | 12/1979 | Lamanna et al. | 400/130 X |
| 4,255,073 | 3/1981 | Schottle | 400/134.3 X |
| 4,276,824 | 5/1981 | Schottle | 101/18 |
| 4,461,587 | 7/1984 | Schottle | 400/131 |
| 4,462,708 | 7/1984 | Luartes et al. | 400/130 X |
| 4,519,600 | 5/1985 | Warwick et al. | 271/4 |
| 4,548,519 | 10/1985 | Schroeder | 400/61 |
| 4,686,898 | 8/1987 | Lamanna et al. | 101/18 |

*Primary Examiner*—Charles Pearson

*Attorney, Agent, or Firm*—Merchant, Gould, Smith, Edell, Welter & Schmidt

[57] ABSTRACT

A method and system (20) for embossing characters on a card (44). A programmed host computer system (24) which interfaces with an embosser (22) includes logic (50) for computing character movement time and card movement time for each character to be embossed on the card (44), selecting the longest of the two values for each character as a character movement time, embossing the character having the shortest character movement time, and then iteratively performing the same process for the remaining characters such that the characters are embossed in a very time efficient manner.

7 Claims, 4 Drawing Sheets

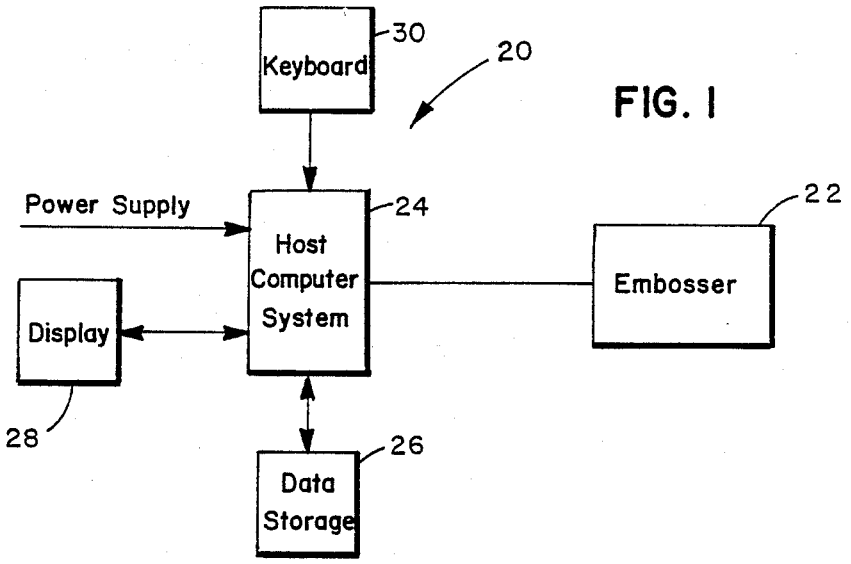
FIG. 1
FIG. 2
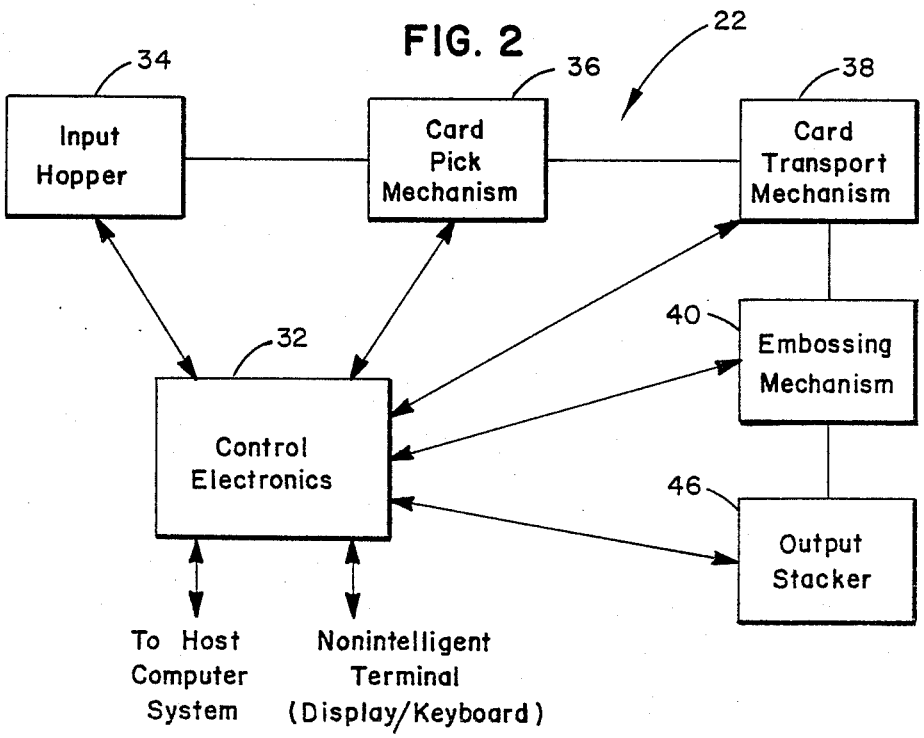

FIG. 3
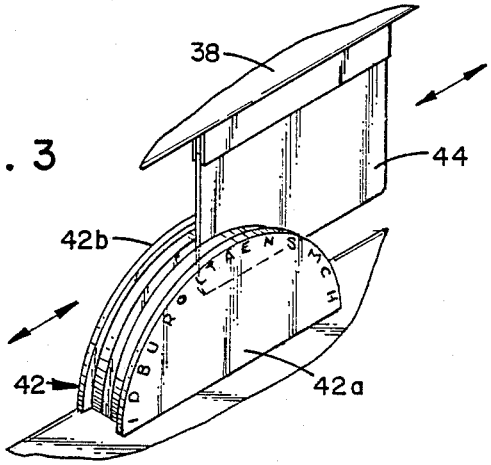
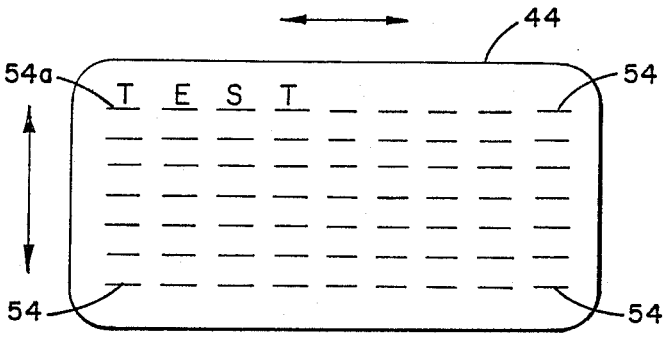
FIG. 4
FIG. 5
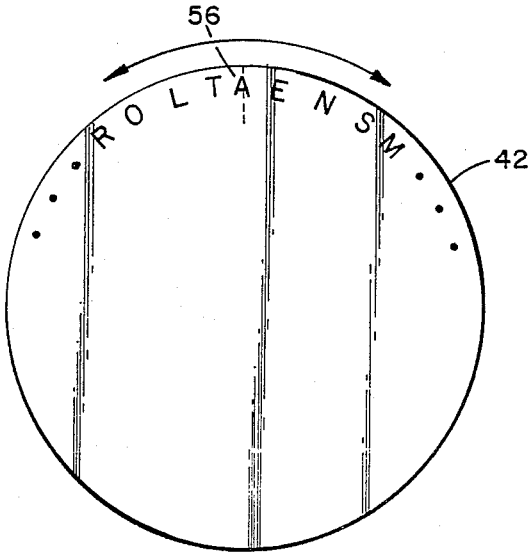

Emboss Character Work Buffer

Wheel Table

Card Movement Time Table

Wheel Movement Time Table

EMBOSSING METHOD AND APPARATUS

BACKGROUND OF THE INVENTION

The present invention relates to an automatic method and system for embossing characters on a card such as a plastic card. More particularly, the present invention relates to such a method and system which reduces the time required for such embossing of characters.

Automated embossing systems are widely used for embossing characters on media such as plastic. Typical applications of such embossing systems are the creation of credit cards, identification cards, membership cards, etc. Examples of embossing system patents are U.S. Pat. Nos. 3,820,455; 4,088,216; and No. Re. 27,809.

In large embossing systems where large quantities of cards are being embossed, any reduction of time required to emboss each card can result in substantial cost reduction and increased card production. One area where time savings can be realized is the operation and movement of the embossing wheel relative to the card where the characters are embossed. In some embossing systems, characters are consecutively embossed as they appear on a given line of embossing. In yet other systems, like characters are consecutively embossed; i.e., all the A's, B's, C's, etc. The present invention provides an embossing system and method which provides increased performance over the above described embossing systems.

SUMMARY OF THE INVENTION

The present invention relates to an embossing system for embossing a card at a plurality of character locations with characters in accordance with particular character data to be embossed on the card by use of a rotatable embossing wheel assembly including a set of character embossing elements disposed at predetermined spaced locations about the periphery of the embossing wheel assembly and card transport means for moving the card so as to individually place each of the character locations to be embossed into embossing position relative to the embossing wheel assembly. The embossing system includes character data memory means for storing in a predetermined data format, character data to be embossed on the card. The character data includes for each character, its character location on the card relative to an index position and an identifier associating each of the characters with one of the character embossing elements of the embossing wheel assembly. Embossing wheel memory means is provided for storing the location of each of the character embossing elements on the embossing wheel assembly relative to a home position. Data processing means includes means for computing for each character to be embossed on the card, a first time interval required to move the card such that its associated character location is in embossing position. The data processing means further includes means for computing for each character to be embossed on the card a second time interval required to rotate its associated character embossing element into embossing position, means for comparing the first and second time intervals for each character to be embossed and saving in memory the longest of the two time intervals as a character movement time, means for comparing the character movement time of each character to be embossed and selecting the character having the smallest of the character movement times, means for causing movement of the card and the embossing wheel assembly into embossing position for embossing the character having the smallest character movement time, means for discarding the embossed character from the character data memory means, and means for iteratively selecting the character from the character data memory means having the smallest character movement time until all of the characters have been embossed.

The present invention also relates to a method for embossing a card at a plurality of character locations with characters in accordance with particular character data to be embossed on the card by use of a rotatable embossing wheel assembly and card transport means for moving the medium so as to individually place each of the character locations to be embossed into embossing position relative to the embossing wheel assembly. The method includes the step of storing in memory in a predetermined data format character data to be embossed on the card, the character data including for each character, its character location on the card relative to an index position and an identifier associating each of the characters with one of the character embossing elements on the embossing wheel assembly, storing in memory the location of each of the character embossing elements on the embossing wheel assembly relative to a home position, computing for each character to be embossed on the card a first time interval required to move its associated character location into embossing position, computing for each character to be embossed on the card a second time interval required to rotate its associated character embossing element into embossing position, comparing the first and second time intervals for each of the characters to be embossed and saving the longer of the two time intervals as a character movement time, comparing the character movement times for each of the characters to be embossed and selecting the character having the smallest of the character movement times, moving the card and the embossing wheel assembly into embossing position for embossing the character having the smallest character movement time, discarding the embossed character's character data from memory, and iteratively repeating the steps above, with the exception of the first two storing steps, and selectively embossing the character having the smallest character movement time until all of the characters have been embossed.

In addition to other features and advantages, the present invention provides a system and method of embossing characters onto a card which is time efficient. The term card as used in this application is meant to encompass a number of different media sizes and configurations. One particular application of the present invention, is its use in embossing plastic cards such as are used for credit, identification, licenses, etc.

These and various other advantages and features of novelty which characterize the present invention are pointed out with particularity in the claims annexed hereto and forming a further part hereof. However, for a better understanding of the invention, its advantages and objects attained by its use, reference should be had to the drawings which form a further part hereof, and to the accompanying descriptive matter, in which there is illustrated and described a preferred embodiment of the present invention.

BRIEF DESCRIPTION OF THE DRAWINGS

In the drawings wherein like reference numerals and letters indicate corresponding elements throughout the several views:

FIG. 1 is a block diagram illustrating an embosser system and its host computer system;

FIG. 2 is a block diagram illustrating elements of an embosser system;

FIG. 3 is a diagrammatic perspective view illustrating movement of a card relative to an embossing wheel assembly;

FIG. 4 is a plan view of a card having the word test embossed thereon, its associated character positions being further illustrated;

FIG. 5 is a diagrammatic plan view of an embossing wheel assembly;

DETAILED DESCRIPTION OF A PREFERRED EMBODIMENT

Figure 6:
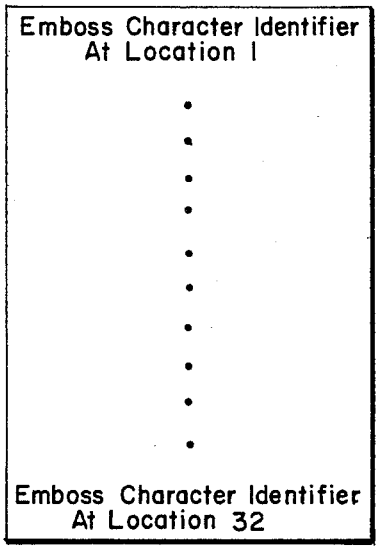
FIG. 6 is a diagrammatic view of character card location information stored in electronic memory.

Referring now to the figures, there is illustrated an embodiment of an embossing system and method in accordance with the principles of the present invention, the embossing system being generally referred to by the reference numeral 20. The embosser system is illustrated in FIG. 1 as including an embosser 22 and its host computer system 24. The host computer system is typically used to transmit character data to the embosser 22 which is to be embossed on media such as plastic cards. The host computer system 24 in addition to including its processor and associated internal memory is further illustrated as including a data storage device 26, also referred to as a memory device, which stores the character data to be embossed on a medium such as a plastic card. In addition, the host computer system 24 is shown as including a display, typically a cathode ray tube (CRT) device, 28 for presentation of embosser system information to an operator and a keyboard 30 or other input device for operator input into the host computer system 24. The host computer system 24 might be one of any number of well known and currently available micro computer systems; e.g., an IBM compatible XT or AT.

Illustrated in FIG. 2, is a block diagram of an embosser 22 illustrating its various operational elements. Control electronics 32 includes a processor and program logic for controlling the various operational elements and interfacing with the host computer system 24. The program logic might be resident in read only memory (ROM) and executed in ROM or might be downloadable from ROM or other memory storage devices into random access memory (RAM). The control electronics 32 might also interface with other intelligent systems or with a non-intelligent terminal having a display/keyboard arrangement for operator input and display of embosser operating information. Although not shown, a control panel will typically be present at the embosser 22 to enable operator control over various embosser functions and provide an indication of embosser status.

An input hopper 34 holds a supply of blank cards which are to be embossed. (It will be appreciated, that when reference is made to cards throughout this application, it is intended to refer to all types of media and documents of various sizes. One anticipated application of the present invention is its use in the plastic card embossing industry.) A card pick mechanism 36 individually picks the cards from the input hopper 34 and transfers them to the card transport mechanism 38. The card transport mechanism 38 individually positions the cards for embossing. The card transport mechanism 38 is typically capable of moving the picked card in a plane between the punches and dies of an embossing mechanism 40. The movement of the card transport mechanism 38 is controlled by the control electronics depending where on the card character information is to be embossed. In some embossers, the embossing mechanism 40 includes cooperating punch and die elements (not shown) mounted on first and second spaced apart wheel elements 42*a,b* of a rotatable wheel assembly 42. The card transport mechanism 38 positions a card 44 between the cooperating wheel elements 42*a,b*. Once the card 44 is positioned between the wheel elements 42*a,b*, the card transport mechanism moves the card vertically and horizontally in a plane so as to enable the characters to be individually embossed at their respective positions on the card 44. The embossing wheel assembly 42, in turn, is rotated under control of the control electronics 32 such that the wheel assembly is properly positioned relative to the character position on the card 44 to enable the selected character to be embossed. After each of the cards are embossed, they are positioned in an output stacker 46.

The above described embosser elements may take on any number of configurations and operational characteristics and are well known in the industry. The present invention relates in particular to the method and system for determining the order in which the characters are to be embossed on a given card. Preferably this includes program logic resident in memory of the control electronics 32 for controlling the movement of the wheel assembly 42 and the card transport mechanism 38. In some embodiments, although not as practical, this might consist of a computer program stored on the data storage device 26 of the host computer system 24. The program might be down loadable to the memory of the control electronics 32 when the embossing of cards is initiated. Also it is conceivable that the host system 24 might execute the program with its processor and then send corresponding control signals to the control electronics 32 for directing movement of the card transport mechanism 38 and the embossing mechanism 40.

Figure 10:
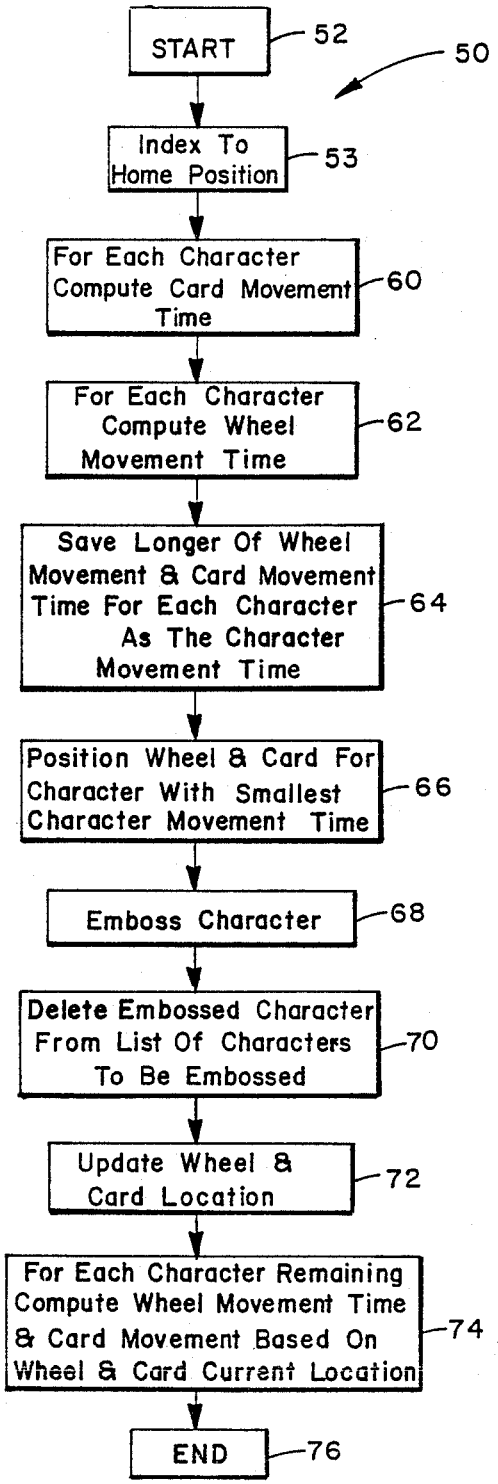
FIG. 10 is a logic block diagram illustrating computer program operation.

A logic flow diagram 50 for an embodiment of the program logic which might be resident in the control electronics 32 is illustrated in FIG. 10. The logic flow diagram 50 illustrates either the steps taken in embossing a given line of characters on the card or in embossing all the lines of characters on the card simultaneously. If the transport mechanism 38 cannot readily move the card in a vertical direction then the logic flow might apply only to a given line such that each line of characters is sequentially embossed. However, if the transport mechanism 38 is capable of moving the card in a vertical as well as horizontal direction, then the logic flow might apply to all the characters regardless of their line location.

The computer program is started at 52. At block 53 of the logic flow diagram 50, the card 44 and the embossing wheel assembly 42 are indexed to a home position. FIG. 4 illustrates possible character locations 54 on the card 44 by horizontal lines. The card 44 illustrated in FIG. 4 has seven rows of character locations 54 with eight character locations 54 per row. The word TEST is illustrated as being embossed on the card 44. It will be appreciated that the card 44 might have any number of character locations 54. Character location **54*a* is the home position, also referred to as the index position, of the card 44. The wheel assembly 42 is illustrated in FIG. 5 as having a home position illustrated by line 56. The home position 56 might correspond to a particular embossing element location as illustrated in FIG. 5 where the home position 56 overlies the embossing element for the character "A" or the home position 56 might correspond to a vacant position on the wheel assembly 42. (Embossing elements for individual characters are illustrated in FIG. 5 as the corresponding characters. It will be appreciated that any number of characters in any number of locations relative to the home position 58 may be present on the embossing wheel assembly 42.) When properly indexed, the character location 54*a* will be aligned with the home position 56 of the wheel assembly 42**.

At block 60 the individual card movement times required to move each of the character locations 54 on the card 44 into embossing position relative to the home position of the embossing wheel assembly 42 is computed. As discussed above this may be done on a line for line basis if the transport mechanism 38 is unable to readily move in the x-y plane but rather is more readily moved along the x axis. Likewise, if the transport mechanism 38 were more readily moveable along the y axis, this might be done on a column for column basis. At block 62, the individual wheel movement times required to move each of the corresponding character embossing elements on the embossing wheel assembly 42 into embossing position; i.e., to the home position, are calculated.

In one embodiment of the invention, the character data to be embossed is transferred into a data area, also referred to as a work buffer, according to its location in the line of characters which is being embossed. An example of such a buffer is shown in FIG. 6, and is referred to as an emboss character work buffer. In this example each line is capable of having 32 characters per line and thus there are 32 locations provided in the data area, one for each potential character identifier. Spaces will fill those locations corresponding to locations on the line where there are no characters. It will be appreciated that there may be any number of characters per line in different embodiments. Furthermore, if all the lines of the card were to be embossed simultaneously, the data area would include a location for all possible character locations in all lines on the surface of the card.

Figure 7:
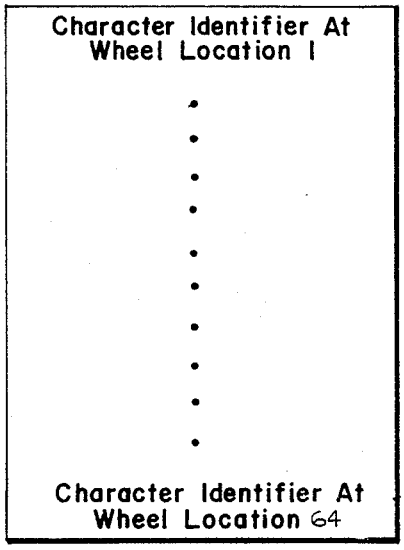
FIG. 7 is a diagrammatic view of character wheel location information stored in electronic memory.
Figure 8:
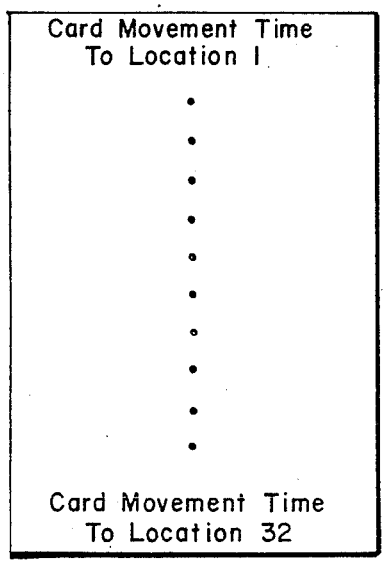
FIG. 8 is a diagrammatic view of card movement time information.
Figure 9:
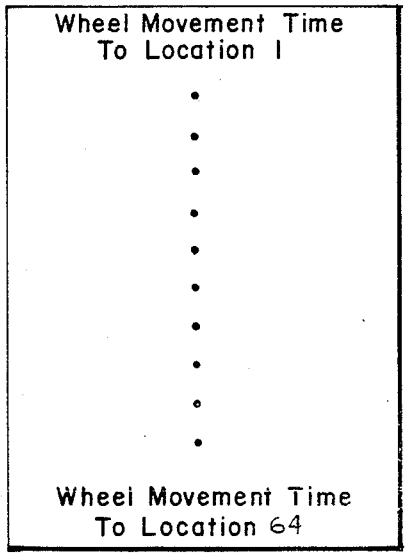
FIG. 9 is a diagrammatic view of wheel movement time information.

Similarly, a wheel location/identifier data area might be provided as illustrated in FIG. 7, and referred to as a wheel table, where each character embossing element identifier would be stored according to its corresponding location on the wheel. As illustrated in FIGS. 8 and 9, also referred to as Card Movement Time Table and Wheel Movement Time Table, one embodiment of the present invention might also include card and wheel movement data areas, respectively. These data areas would include the time required to move to each location on the card and the wheel, respectively from a given position, preferably the home position. The program logic by making use of these data areas and others will be able to compute the card movement time and the wheel movement time. It will be appreciated that any number of programming techniques might be used in accordance with the principles of the invention.

For each character to be printed, the longer of its corresponding wheel movement and card movement times are saved as the character movement time at block 64 since this represents the time it would take to move both the card and the embossing wheel assembly 42 into position to enable embossing of that character. At 66, the character having the smallest character movement time is selected and the embossing wheel assembly 42 and the card 44 are moved into corresponding position and at block 68 are embossed. At block 70 the embossed character is deleted from the list of characters to be embossed or otherwise flagged to indicate that it has been embossed. At 72, the new current wheel and card locations are updated in memory and at block 74, steps 60 through 70 are repeated for each of the remaining characters in an iterative fashion until all the characters have been embossed at which point program ends at block 76. If the characters are being embossed on a line by line basis, the remaining lines are then similarly embossed.

In some situations, various sizes (fonts) of characters may be printed on the card. In the above described embodiment, the movement calculations will be calculated for a given size of character. Once all characters of that size in a given line or on the card have been embossed, then characters of a different font size will be embossed. In the above described data areas, a separate character movement data area might be provided for each font size since the character movement time will vary with the font size. The wheel movement data area will stay the same for many systems since the wheel movement time from one location to another is the same regardless of the character font size. In yet other embodiments of the invention all characters might be embossed at the same time based on movement times regardless of their font size.

The present invention saves considerable time in the embossing process. It is to be understood that even though numerous characteristics and advantages of the present invention have been set forth in the foregoing description, together with details of the structure and function of the invention, the disclosure is illustrative only and changes may be made in detail, especially in matters of the embosser working elements and their operation, and the supporting hardware and software routines and data structures, to the full extent indicated by the broad general meaning of the terms in which the appended claims are expressed.

What is claimed is:

1. An embossing system for embossing a card at a plurality of character locations with characters in accordance with particular character data to be embossed on the card by use of a rotatable embossing wheel assembly including a set of character embossing elements disposed at predetermined spaced locations about the periphery of the embossing wheel assembly and card transportation means for moving the card so as to individually place each of the character locations to be embossed into embossing position relative to the embossing wheel assembly; the embossing system comprising:

(a) character data memory means for storing in a predetermined data format, character data to be embossed on the card, the character data including for each character, its character location on the card relative to an index position and an identifier associating each of the characters with one of the character embossing elements of the embossing wheel assembly;

(b) embossing wheel memory means for storing the location of each of the character embossing elements on the embossing wheel assembly relative to a home position; and (c) data processing means including:

(i) means for computing for each character to be embossed on the card, a first time required to move its associated character location into embossing position;

(ii) means for computing for each character to be embossed on the card a second time required to rotate its associated character embossing element into embossing position;

(iii) means for comparing the first and second times for each character to be embossed and saving the longer of the two times as a character movement time;

(iv) means for comparing the character movement time of each of the characters to be embossed and selecting the character having the smallest of the character movement times;

(v) means for causing movement of the card and the embossing wheel assembly into embossing position for embossing the character having the smallest of the character movement times;

(vi) means for discarding the embossed character from the characters in the character data memory means which are yet to be embossed; and (vii) means for iteratively selecting the character from the character data memory means having the smallest character movement time and embossing the same until all of the characters have been embossed.

2. A system in accordance with claim 1, wherein the data processing means includes means for embossing all the characters on a given row of the card sequentially according to their character movement times before any characters appearing in other rows of the card are embossed.

3. A system in accordance with claim 1, wherein the data processing means includes means for embossing all the characters to be embossed on the card sequentially according to their character movement time regardless of which row and column the characters might be in.

4. A method for transferring to a medium at a plurality of character locations characters in accordance with particular character data to be transferred to the medium by use of a character transfer mechanism and a transport mechanism for movement of the medium relative to the character transfer mechanism, the method comprising the steps of:

(a) determining for each character to be transferred a first time interval required to move the medium relative to the transfer mechanism such that the character is in a transfer position and a second time interval required to move the transfer mechanism into the transfer position;

(b) comparing the first and second time intervals for each character to be transferred and saving the longer of the two time intervals as the character movement time;

(c) comparing the character movement times for the characters to be transferred and transferring the character having the smallest character movement time; and (d) iteratively comparing the character movement times for the characters which have not yet been transferred and sequentially transferring the characters based on their character movement times.

5. A method for embossing a card at a plurality of character locations with characters in accordance with particular character data to be embossed on the card by use of a rotatable embossing wheel assembly and card transportation means for moving the card so as to individually place each of the character locations to be embossed into embossing position relative to the embossing wheel assembly; the method comprising the steps of:

(a) storing in memory in a predetermined data format character data to be embossed on the card, the character data including for each character, its character location on the card relative to an index position and an identifier associating each of the characters with one of the character embossing elements of the embossing wheel assembly;

(b) storing in memory the location of each of the character embossing elements on the embossing wheel assembly relative to a home position;

(c) computing for each character to be embossed on the card, a first time interval required to move its associated character location into embossing position;

(d) computing for each character to be embossed on the card a second time interval required to rotate its associated character embossing element into embossing position;

(e) comparing the first and second time intervals for each character and saving in memory for each character to be embossed the longest of the two time intervals as a character movement time;

(f) comparing the character movement times for each of the characters to be embossed and selecting the character having the smallest of the character movement times;

(g) moving the card and the embossing wheel assembly into embossing position for embossing the character having the smallest of the character movement times; and (h) iteratively repeating steps c through g and selectively embossing the character having the smallest character movement time until all of the characters have been embossed.

6. A method in accordance with claim 5, wherein the characters in a given row on the card are embossed according to their character movement times before embossing any characters appearing elsewhere on the card.

7. A method in accordance with claim 5, wherein all the characters on the card are embossed according to their character movement time regardless of their row or column.

* * * * *

UNITED STATES PATENT AND TRADEMARK OFFICE

CERTIFICATE OF CORRECTION

PATENT NO. : 4,747,706

DATED : May 31, 1988

INVENTOR(S) : Duane Duea

It is certified that error appears in the above-identified patent and that said Letters Patent is hereby corrected as shown below:

Title Page under References Cited, Line 3, "Rudisoh et al." should be --Rudisch et al.--.

Title Page under References Cited, Line 7, "Lamanna et al." should be --LaManna et al.--.

Title Page under References Cited, Line 9, "Lamanna et al." should be --LaManna et al.--.

Title Page under References Cited, Column 2, Line 2, "4,276,824 5/1981" should be --4,276,824 7/1981--.

Title Page under References Cited, Column 2, Line 7, "Lamanna" should be --LaManna--.

Signed and Sealed this

Seventeenth Day of January, 1989

*Attest:*

DONALD J. QUIGG

*Attesting Officer*

*Commissioner of Patents and Trademarks*